United States Patent [19]

Borichevsky

[11] 4,273,379

[45] Jun. 16, 1981

[54] COLLAPSIBLE CHAIR

[75] Inventor: Donald J. Borichevsky, Wells, Vt.

[73] Assignee: The Telescope Folding Furniture Co., Inc., Granville, N.Y.

[21] Appl. No.: 72,160

[22] Filed: Sep. 5, 1979

[51] Int. Cl.[3] ..... A47C 4/32

[52] U.S. Cl. ..... 297/56; 297/441; 297/457

[58] Field of Search ..... 297/56, 57, 24, 25, 297/441, 444, 457, 219, 26, 27, 28, 19, 16, 35, 41, 440

[56] References Cited

U.S. PATENT DOCUMENTS

| | | | |
|---|---|---|---|
| 204,423 | 6/1878 | Closterman | 297/56 |
| 348,716 | 9/1886 | Boggs et al. | 297/27 |
| 1,989,865 | 2/1935 | Johanson | 297/56 |
| 2,492,342 | 12/1949 | Wilson | 297/441 |
| 2,679,287 | 5/1954 | Eiseman | 297/441 |
| 3,348,882 | 10/1967 | Chassaignac | 297/441 |
| 3,437,375 | 4/1969 | Kettler | 297/441 |
| 3,515,430 | 6/1970 | Nelson | 297/219 |
| 3,556,592 | 1/1971 | Antoine | 297/444 |
| 3,977,721 | 8/1976 | Peterson | 297/441 |

*Primary Examiner*—Francis K. Zugel
*Attorney, Agent, or Firm*—Kenyon & Kenyon

[57] ABSTRACT

The chair which can be shipped in a flattened position is easily assembled by spreading the legs of the frames and inserting a screw through a bore in the upper end of a strut into a threaded thimble at the upper end of the longer leg. The chair can be dis-assembled in reverse manner to allow collapsing into a flattened condition for storage.

8 Claims, 7 Drawing Figures

Fig. 3.
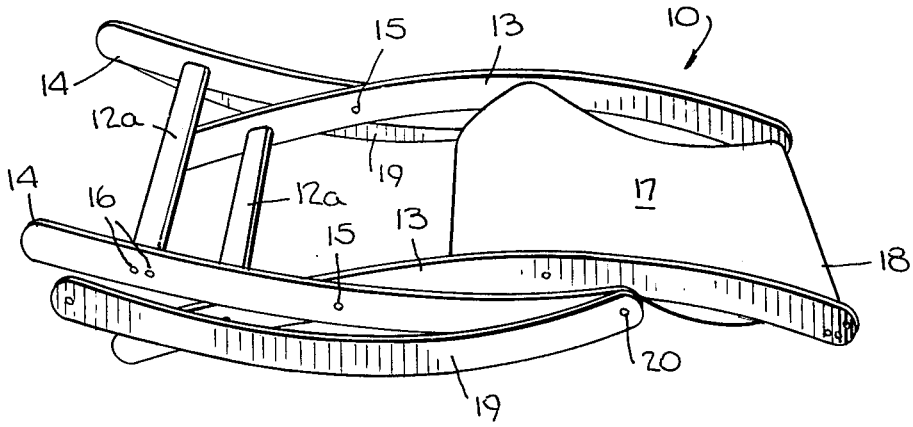
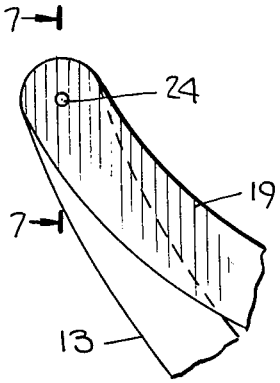
Fig. 6.
Fig. 5.
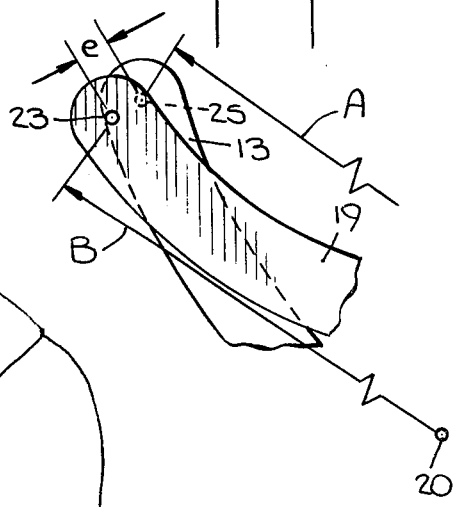
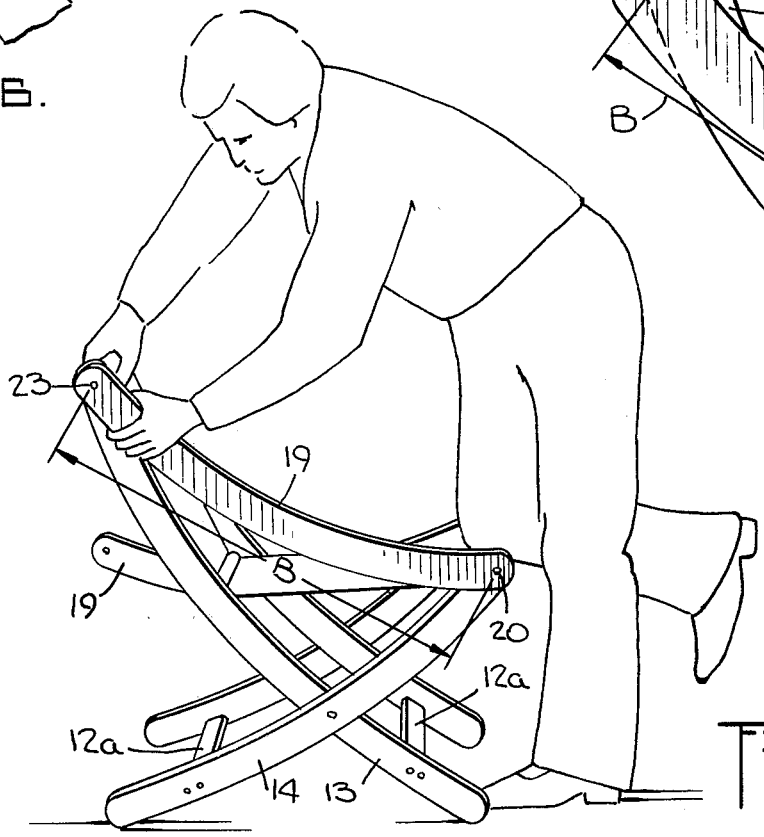
Fig. 4.

COLLAPSIBLE CHAIR

As it is known, various types of collapsible chairs have been made for indoor as well as outdoor use. When made for indoor use, such chairs have generally been of a type which include a rigid seat which is articulated with a collapsible leg frame so as to be folded into a flattened condition. Such chairs have been made of wood or metal construction and generally have been cumbersome to use and have not been of particular aesthetic appearance. When made for outdoor use, these chairs have frequently been made of metallic tubular construction with strips of webbing or plastic tubes secured to frames of metal tubular members. Generally, these outdoor type chairs are not used for indoor use.

It has also been known to construct various types of chairs for indoor or outdoor use which can be assembled from various parts by the ultimate user into a rigid construction. This, however, becomes cumbersome to the user. Further, once assembled these chairs usually require a great deal of space for storage.

Accordingly, it is an object of this invention to provide a collapsible chair of aesthetically pleasing appearance.

It is another object of this invention to provide a collapsible chair for indoor use which can be readily stored when not in use.

It is another object of this invention to provide a chair of collapsible construction which can be easily assembled by the user.

It is another object of this invention to provide a chair of knock down construction which can be shipped or transported in a flattened condition and easily assembled into an opened position.

Briefly, the invention provides a collapsible chair which is comprised of a pair of cross-legged frames wherein each frame has a pair of legs disposed in hinged crossing relation to each other to move between a closed position and an opened position. In addition, one of the legs is of greater length than the other to extend upwardly into a higher plane than the other when in the opened position. The chair also has a plurality of cross-bars which interconnect the frames and a strip of material which is disposed over and is secured to the cross-bars to define a seat support in the opened position, e.g., to receive a cushion. In addition, a pair of struts are provided with each strut hinged to an upper end of the shorter leg of the pair of legs while being releaseably secured by suitable means to an upper end of the longer leg in a manner to bias the legs apart and impart a pre-stress to the strip of material. The legs and struts of the chair are also made of curvilinear shape to impart an aesthetically pleasing appearance to the chair.

The articulation of the elements of the chair is such that the chair can be initially fabricated for shipment in a flattened condition and thereafter assembled by a user into an open position.

The means for releaseably securing each strut to a longer leg includes an internal threaded thimble fitted into an upper end of each longer leg, a bore in each strut at the upper end thereof and a threaded screw which passes through a respective bore into threaded engagement with a respective thimble. In order to impart a pre-stress to the material disposed over the cross-bars, each thimble and bore are disposed to be axially offset from each other before the screw is inserted into the thimble and with the frames in an opened position.

The collapsible chair is constructed to be opened from a closed flattened position wherein the cross-legged frames are disposed in over-lapping relation to each other to an opened position for seating an occupant. When in the closed position, the struts are released from the upper ends of the longer legs of the frames so as to over lie the shorter legs of each frame. In this flattened condition, the chair can be easily transported or shipped in a box of limited volume.

In order to assemble the chair, the cross-legged frames are initially opened. Thereafter, each strut is pivoted about the hinged end into substantial alignment with the upper end of the longer leg of a respective frame. Next, while grasping the rear cross-bar and depressing the front cross-bar, the bore in the strut and the thimble in the longer leg are manually brought into co-axial alignment. A threaded screw is then passed through the bore in the strut and threaded into the thimble to secure the strut to the longer leg. The second strut is then secured in place in similar manner. After assembly of the two struts, a cushion or the like can be placed upon the chair.

These and other objects and advantages of the invention will become more apparent from the following detailed description and appended claims taken in conjunction with the accompanying drawings in which:

FIG. 3 illustrates the chair of FIG. 1 in a closed flattened position with the cushion removed;

FIG. 4 illustrates a view of the strut being aligned with one of the legs of the cross-frame during assembly;

FIG. 5 illustrates a fragmentary view of the initial offset between the bore in a strut and a thimble in a longer leg in accordance with the invention;

FIG. 6 illustrates a view of the upper portions of a strut and upper leg secured together; and FIG. 7 illustrates a view taken on line 7—7 of FIG. 6.

Figure 1:
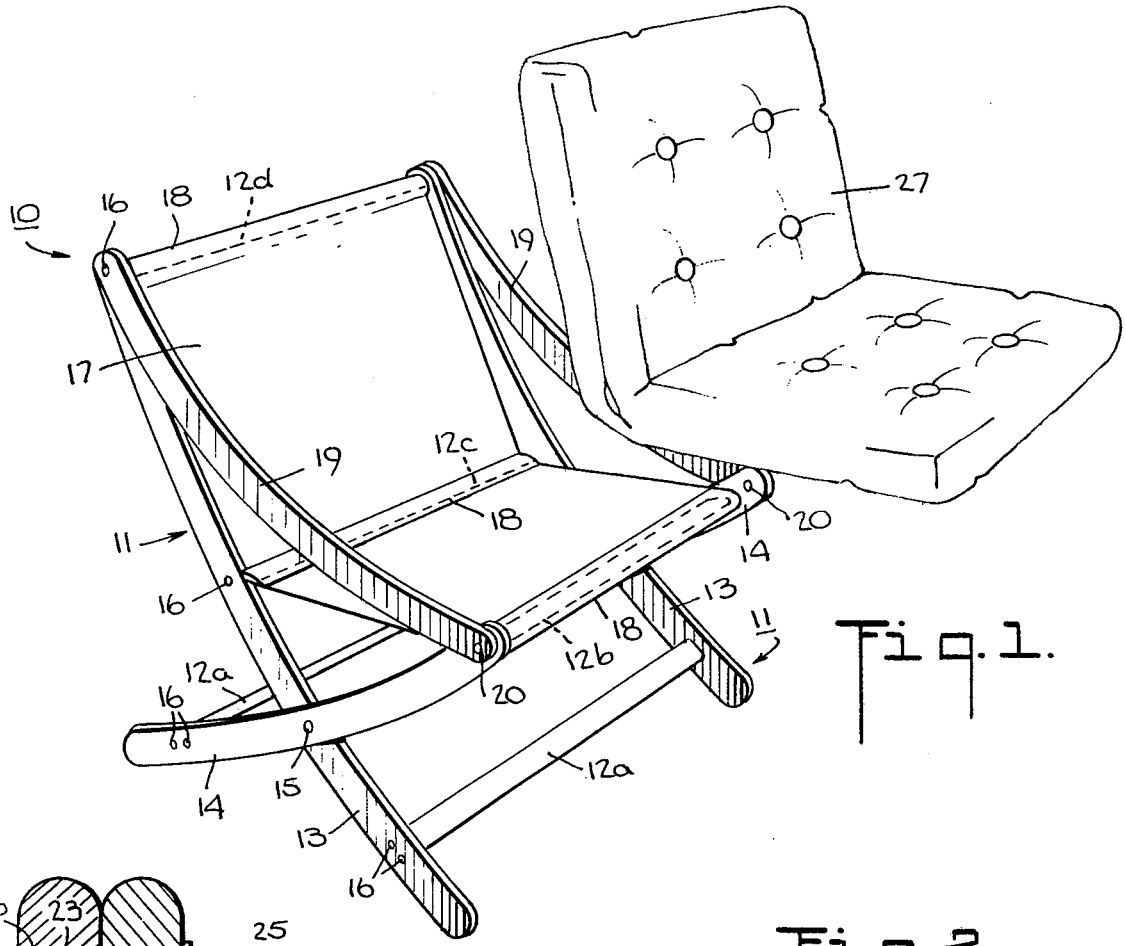
FIG. 1 illustrates an exploded front view of a collapsible chair according to the invention.

Referring to FIG. 1, the collapsible chair 10 which is shown in an opened position includes a pair of cross-legged frames 11 which are disposed in spaced apart parallel relation and which are interconnected by plurality of cross-bars 12. As shown, each frame 11 has a pair of legs 13, 14 which are disposed in hinged crossing relation via a hinge pin 15 at intermediate points relative to each other. In addition, one leg 13 is of greater length than the other leg 14 so as to extend upwardly in the opened position to a higher plane than the shorter leg 14. As indicated, the longer leg 13 extends from a bottom forward point of the chair 10 to an upward rearward point.

Each leg 13, 14 of the cross-legged frames 11 is of curvilinear shape, for example being formed in a convex arcuate shape.

As indicated, there are five cross-bars 12 which interconnect the two frames. Two cross-bars **12*a* are located near the lower ends of the respective legs 13, 14 and are secured to the legs 13, 14 by suitable means such as two screws 16 at each end. The remaining three cross-bars include a front-cross bar 12*b* secured to the upper ends of the shorter legs 14, an intermediate cross-bar 12*c* secured to intermediate portions of the longer leg and a rear cross-bar 12*d* secured at the upper ends of the longer legs 13. In each case, these three bars are secured to the respective legs via a suitable means such as one or more screws 16. Also, the front and intermediate cross-bars 12***b*, 12*c* are located in a common horizontal plane.

The chair 10 also has a strip of material 17 which is disposed over and secured to the front, intermediate and rear cross-bars 12 so as to be shaped into a seat support in the opened position of the frames 11. As indicated, the ends and the intermediate portion of the material strip are formed with loops 18 through which the cross-bars 12 extend.

Referring to FIG. 1, the chair 10 also includes a pair of struts 19 each of which is hinged to an upper end of a short leg 14 of each frame on a horizontal pivot axis via a pivot screw 20 which secures the strut 19 to the leg 14. The opposite end of each strut 19 is releaseably secured to the upper end of a longer leg 13 in such a manner that the struts 19 bias the legs 13, 14 of the two cross-legged frames 11 outwardly while imparting a pre-stress to the strip of material 17.

The means for releaseably securing each strut 19 to the upper end of the longer leg 13, as shown in FIG. 7, is in the form of an internally threaded thimble 22 which is fitted within the upper end of each of the longer legs 13, a bore 23 in the upper end of each strut 19 at a point spaced from the pivot screw 20 (not shown) and a threaded screw 24 which passes through the bore 23 in the strut 19 into the thimble 22 in threaded engagement.

As indicated in FIG. 7, each thimble 22 is fixedly secured in the leg 13 on an axis 25 and is passed into the leg 13 from a side opposite the strut 19. The screw 24 is formed with a head 26 which fits into a suitable recess 27 within the strut 19 to form a smooth surface therewith when threaded into the thimble 22.

In order to effect a pre-stress, each bore 23 and respective thimble 22 are initially disposed in axially offset relation (FIG. 5) with respect to each other when the chair 10 is an initially opened condition. Consequently, when the threaded screw 22 is put into place, the bore 23 and thimble 22 are brought into co-axial alignment while, at the same time, the legs 13, 14 of each frame 11 are biased away from each other and the strip of material 17 is pre-stressed. As shown in FIG. 4, the distance A between the pivot screw 20 and the axis 25 is less than the distance B between the pivot screw 20 and the axis of the bore 23 with the screw 24 removed. Thus, the bore 23 and thimble 23 are offset by a distance e of about ¼ inch relative to their respective axes.

Figure 2:
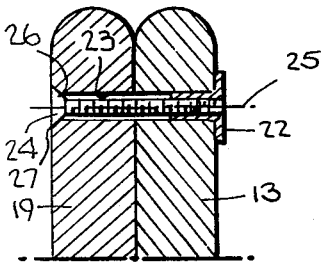
FIG. 2 illustrates a perspective rear view of the chair of FIG. 1.
Figure 2:
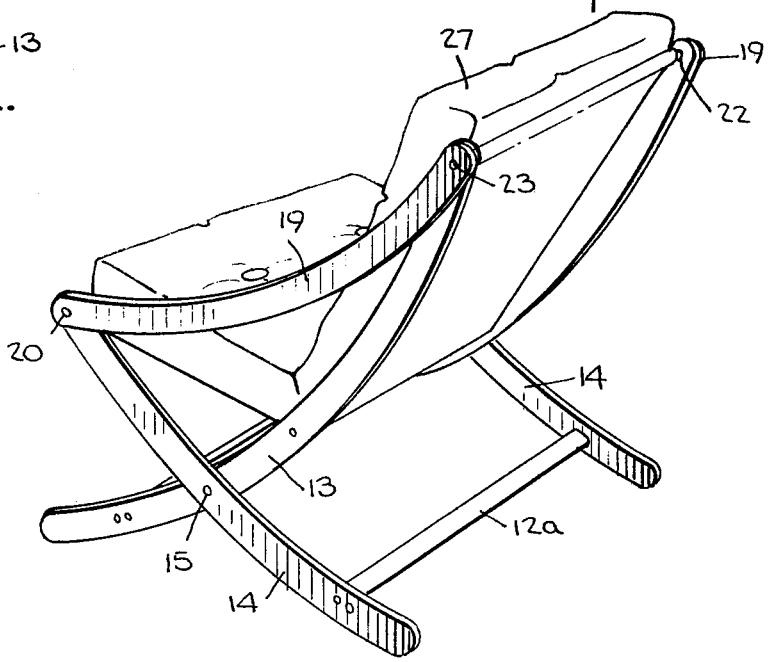

When in the opened position, the chair 10 receives a cushion 27 (FIGS. 1 and 2) to provide a comfortable seat for an occupant. The cushion 27, as shown, forms both a seat portion and a backrest portion conforming to the general contour of the chair 10.

Referring to FIG. 3, when in a flattened condition, the legs 13, 14 of each frame 11 are scissored together to close up the chair 10. At the same time, the struts 19 are disposed in over lapping relation to the shorter legs 14 of the frames 11. In this regard, the curvature of the struts 19 is similar to the curvature of the shorter legs 14 so as to be substantially parallel with the shorter legs 19 in the closed flattened position. When in this position, the chair 10 can be easily inserted into a box for transportation to an ultimate user. Also, in this condition, the chair 10 can be easily stored by an ultimate user in a minimum of space.

In order to assemble the chair 10, the frames 11 are initially opened. In this condition, the cross-legged frames 11 are disposed in an opened condition (see FIG. 4) and the struts 18 are secured via the screws 21 only at the forward ends of the shorter legs 14. Thereafter, each strut 18 is pivoted, in turn, on the screw 21 into substantial alignment with the upper end of a longer leg 13. Next, the assembler presses down on the forward cross-bar 12*b* (FIG. 4), for example via a knee, while pressing on the rear cross-bar, for example with a hand. By spreading the front and rear cross-bars 12*b*, 12*d* apart, the bore 23 in the strut 18 and the thimble 22 are brought from a nonaligned position (FIG. 5) into an aligned position (FIG. 6) so that a screw 24 can be threaded into the thimble 22 through the strut 19. After threading of the screw 24 in place, pressure is released from the cross-bars 12*b*, 12*d*. This procedure is then repeated for the remaining strut 19. Thereafter, the chair 10 is in a fully opened condition with the strip of material 17 held entirely in a taut manner under a pre-stress to form a firm seat support. Thereafter, the cushion 27 is placed on the seat support and the chair 10 is ready for occupancy.

The chair 10 can be readily disassembled in a reverse manner with a minimum of tools to permit storage of the chair 10 in a flattened condition when not in use.

The chair 10 can be made of any suitable materials, for example, the legs 13, 14 and struts 18 may be made of wood with an aesthetically pleasing appearance. For example, the legs and struts may be made of wood with a width of about 1½ inches and a thickness of about ½ inch. Any suitable finish may be applied to the wooden legs 13, 14 and struts 18 for indoor and outdoor use. In addition, the cross-bars 12 may be made of flattened shape or of round dowel-like shape.

The strip 17 which is secured to the cross-bars 12 can be of any suitable material and of pleasing appearance, such as a fabric cloth having a colorful pattern thereon. The cushion 27 can be made of matching fabric and patterns.

The invention thus provides a chair of collapsible construction which not only forms a rigid assembly for seating purposes due to the pre-stressing of the material strip 17 but also has an aesthetically pleasing appearance, due particularly to the curved shape of the legs and struts.

Further, the invention provides a chair which can be easily transported in a flattened position, saving space and transportation costs, and which can be readily assembled into an opened position with a minimum of tools and effort.

It is noted that when the two struts are secured in place, the struts 19 slant inwardly from the short leg 14 to the long leg 11. This imparts somewhat of an A-shape to the chair 10 when viewed from the front or back.

What is claimed is:

1. A collapsible chair comprising a pair of frames disposed in spaced parallel relation, each frame having a pair of legs disposed in hinged crossing relation to each other to permit movement of said legs between a closed over-lapping position and an opened position relative to each other, one of said legs of each said pair of legs extending upwardly to a higher plane than the other leg of said pair of legs in said opened position;

a plurality of cross-bars interconnecting said frames together, said cross-bars including a front cross-bar secured to an upper end of each said other leg, an intermediate cross-bar secured to intermediate portions of each said one leg, and a rear cross-bar secured to an upper end of each said one leg;

a strip of material secured to and over said front, intermediate and rear cross-bars; and a pair of struts, each strut being hinged to said upper end of a respective said other leg and releaseably secured to said upper end of a respective one leg biasing said legs apart and imparting a pre-stress to said material in said opened position.

2. A collapsible chair as set forth in claim 1 wherein each strut is curved towards a respective frame.

3. A collapsible chair as set forth in claim 1 wherein said front cross-bar and said intermediate cross-bar are disposed in a common horizontal plane in said opened position.

4. A collapsible chair as set forth in claim 1 wherein each strut and said other leg of a respective frame are disposed in overlapping relation in said closed position with each strut released from said one leg of each respective frame.

5. A collapsible chair as set forth in claim 1 which further comprises means for removably securing each strut to a respective one leg at said upper end thereof.

6. A collapsible chair as set forth in claim 5 wherein said means includes an internally threaded thimble in each said one leg at an upper end thereof, a bore in each strut at an upper end thereof and a threaded screw passing through each bore into threaded engagement with a respective thimble.

7. A collapsible chair as set forth in claim 6 wherein each thimble and respective bore are disposed to be axially offset from each other and said material is unstressed with said screw removed from said thimble and with said frames in said opened position.

8. A collapsible chair as set forth in claim 6 wherein each strut is hinged to said upper end of a respective other leg on a pivot axis, said thimble in each said one leg is disposed on a second axis and said bore in each strut is located on a given axis whereby the distance between said pivot axis and said aperture axis is less than the distance between said pivot axis and said given axis with said screw removed in said opened position.

* * * * *